US007673400B2

(12) United States Patent
Brown et al.

(10) Patent No.: US 7,673,400 B2
(45) Date of Patent: Mar. 9, 2010

(54) GOLF SHOE OUTSOLE

(75) Inventors: Ashley J. Brown, Portsmouth, NH (US); Thomas Gray, Kensington, NH (US); Jonathan G. Bacon, Westford, MA (US); John J. Erickson, Brockton, MA (US); James M. Feeney, Marion, MA (US); Douglas K. Robinson, Jr., Mansfield, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/485,968

(22) Filed: Jun. 17, 2009

(65) Prior Publication Data

US 2009/0249648 A1 Oct. 8, 2009

Related U.S. Application Data

(63) Continuation-in-part of application No. 11/774,733, filed on Jul. 9, 2007.

(51) Int. Cl.
*A43B 5/00* (2006.01)
*A43B 13/00* (2006.01)

(52) U.S. Cl. ..... 36/127; 36/134; 36/67 A

(58) Field of Classification Search ..... 36/102, 36/103, 127, 25 R, 67 A, 31, 15, 134
See application file for complete search history.

(56) References Cited

U.S. PATENT DOCUMENTS

| | | | | |
|---|---|---|---|---|
| 1,422,716 | A | | 7/1922 | Jones |
| 3,550,597 | A | | 12/1970 | Coplans |
| 5,797,199 | A | | 8/1998 | Miller et al. |
| 5,799,417 | A | * | 9/1998 | Burke et al. ..... 36/105 |
| 5,926,974 | A | | 7/1999 | Friton |
| 5,979,083 | A | | 11/1999 | Robinson, Jr. et al. |
| 6,018,889 | A | | 2/2000 | Friton |
| 6,023,859 | A | * | 2/2000 | Burke et al. ..... 36/105 |
| 6,145,221 | A | * | 11/2000 | Hockerson ..... 36/126 |
| 6,161,315 | A | * | 12/2000 | Dalton ..... 36/134 |
| 6,226,896 | B1 | | 5/2001 | Friton |
| 6,817,117 | B1 | | 11/2004 | Campbell |
| 7,076,890 | B2 | * | 7/2006 | Grove et al. ..... 36/15 |
| 7,143,529 | B2 | | 12/2006 | Robinson, Jr. et al. |
| 7,249,426 | B2 | * | 7/2007 | Romano et al. ..... 36/93 |
| 7,444,767 | B2 | * | 11/2008 | Kilgore et al. ..... 36/30 R |
| 7,451,557 | B2 | * | 11/2008 | McDonald et al. ..... 36/100 |
| 2005/0217148 | A1 | | 10/2005 | Connolly et al. |
| 2006/0168847 | A1 | * | 8/2006 | Myers et al. ..... 36/3 B |
| 2006/0242863 | A1 | * | 11/2006 | Patmore ..... 36/127 |
| 2007/0107264 | A1 | * | 5/2007 | Meschter et al. ..... 36/76 R |
| 2008/0127521 | A1 | * | 6/2008 | Hogan ..... 36/103 |

* cited by examiner

*Primary Examiner*—Jila M Mohandesi
(74) *Attorney, Agent, or Firm*—D. Michael Burns

(57) ABSTRACT

The present invention is directed towards a golf shoe outsole that is comprised of a generally soft, and flexible base having a plurality of raised portions on the lower surface of the base, a pair of flexing supports that are placed on the lower surface of the base in an abutting relationship with the raised portions, a pair of chassis that fit over and about the base and a two-piece arch support that acts as a shank for the arch section of the base. The base has a plurality of raised portions that are of a size shape, and number to correspond and mesh together with a plurality of cleat containing pods that are molded to both chassis. The two-piece arch support allows for the necessary rigidity in the arch area of the shoe which is vital for a good golf swing.

21 Claims, 5 Drawing Sheets

GOLF SHOE OUTSOLE

CROSS REFERENCE TO RELATED APPLICATIONS

This application is a continuation-in-part of U.S. patent application Ser. No. 11/774,733, filed Jul. 9, 2007, now pending the disclosure of which is hereby incorporated by reference in its entirety.

FIELD OF THE INVENTION

The present invention is directed to a golf shoe. More particularly, the present invention is directed to a golf shoe utilizing stability pods to enable greater flexibility, balance, and traction for the golfer.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes have had a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

However, relatively recent studies in biomechanics have sought to better quantify how the 26 bones of the foot move relative to each other during human movements. One particular motion that has been identified is a torsion movement about the long axis of the foot. In effect, the forefoot and rear foot twist relative to each other. It is thought that this movement smoothes the contact between foot and ground, decreasing impacts with the ground as well as providing better ground contact. This observation has led to the development of a golf shoe sole to allow this natural movement.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsion action during use that is applied to the foot by the lifting sections, whereby the heel of the foot is urged upwardly at the inner side and the forefoot is raised upwardly at the outer side, producing a torsion action similar to the natural torsion action of the foot.

Another construction intended to provide greater support to the wearer of the shoe is disclosed in U.S. Pat. No. 5,926,974 to Friton. The Friton shoe has a sole that is not designed for golf, but for hiking. It discloses the use of pods and lugs for traction elements that in combination provide greater traction or irregular ground conditions. However, the teachings of this patent are atypical of what is required for a golf shoe. Patent '974 discloses a plurality of pods that are relatively soft, such that they may fan out and serve as compression cushions therein increasing the area of ground contact to improve traction, much the way the hoofs of a mountain goat react. The present invention utilizes relatively hard pods for an entirely different type of terrain.

There remains a need for an improved outsole for a golf shoe that enables an individual movement of the foot, particularly, the rotation between the rear foot and the forefoot, flexing across the foot of the wearer, and also the ability of the shoe to provide flexibility not just across but longitudinally along the metatarsal area of the foot.

SUMMARY OF THE INVENTION

The present invention is directed towards a golf shoe outsole that is comprised of a generally soft, and flexible base having a plurality of raised portions on the lower surface of the base, a pair of flexing supports that are placed on the lower surface of the base in an abutting relationship with the raised portions, a pair of chassis that fit over and about the base and a two-piece arch support that acts as a shank for the arch section of the base.

An embodiment of the invention has a plurality of stability pods integrally molded to the bottom side of the forward and rear chassis. Each pod is of a size and shape to fit on and about a corresponding raised portion. Each pod having a cleat attaching socket member that fits into a cylindrical receptacle of the raised portion. The cleat attaching mechanism comprises a spiral type turn screw which requires only about a 45° clockwise turn to be properly installed, and about 45° counter-clockwise turn to be removed. The actual cleat fastening mechanism is very well known in the art.

One aspect of the invention places three pods on the forward chassis, and four pods on the rear chassis. For an added measure of traction, each pod has a plurality of hard wear resistant projections extending outwardly for gripping the turf. The pods and projections having a minimum Shore A hardness greater than 95, and the pods extend at least 6.3 mm from the bottom surface of the base.

The present invention uses for the base a thin thermoplastic polyurethane having a Shore A hardness between 75 to 85.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
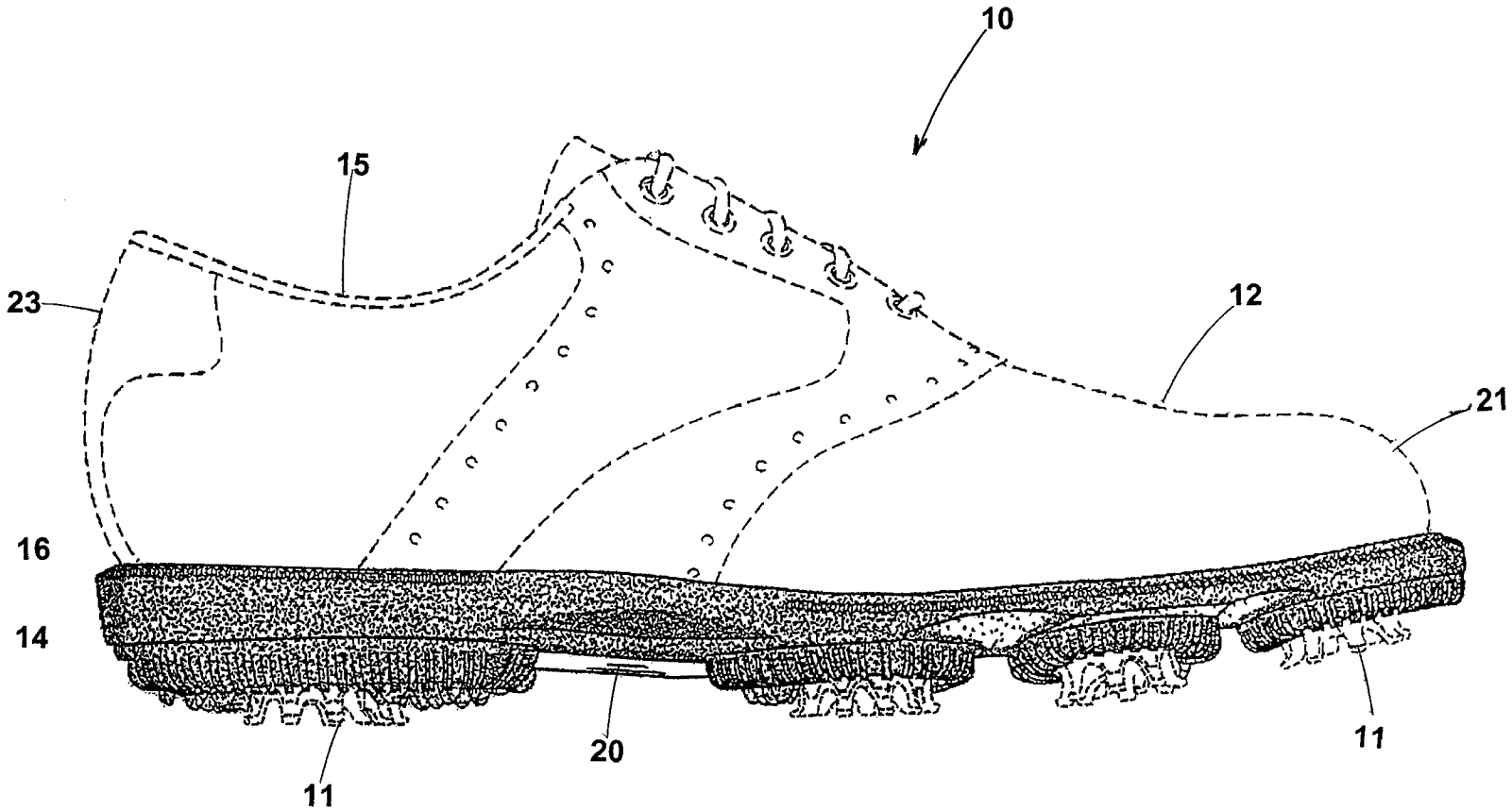
Fig. 1 (Prior Art)
FIG. 1 is a pictorial view of a typical prior art golf shoe having an outsole.

As shown in FIG. 1, a conventional golf shoe 10 usually includes an upper 12, an outsole 14, and typically a lightweight, cushioning mid-sole 16, which connects the upper 12 to the outsole 14. Golf shoes may have cleats 11 which can be metal or non-metal, but in discussing the present invention it is to be assumed that only non-metal cleats will be employed. The upper 12 has a generally conventional shape and is formed from a suitable upper material, such as leather or the like. An opening 15 is formed by the top portion of the upper 12 for receiving a user's foot. The mid-sole 16 provides cushioning to the wearer, and is formed of a material such as an ethylene vinyl acetate copolymer (EVA). Mid-soles 16 may be formed on and about outsole 14, but can be formed separately from the outsole 14 and joined thereto such as by adhesive. Once the mid-sole 16 and the top surface 18 of outsole 14 are joined, the outsole forms a substantial portion of the bottom of shoe 10. Upper 12 is preferably secured to mid-sole 16 with cement or other adhesives using an insole board and conventional techniques, as known by those of ordinary skill in the art. The forward portion 21 of the shoe is also referred to as the toe, the center portion as the arch 20 and the rear portion 23 is referred to as the heel.

Figure 5:
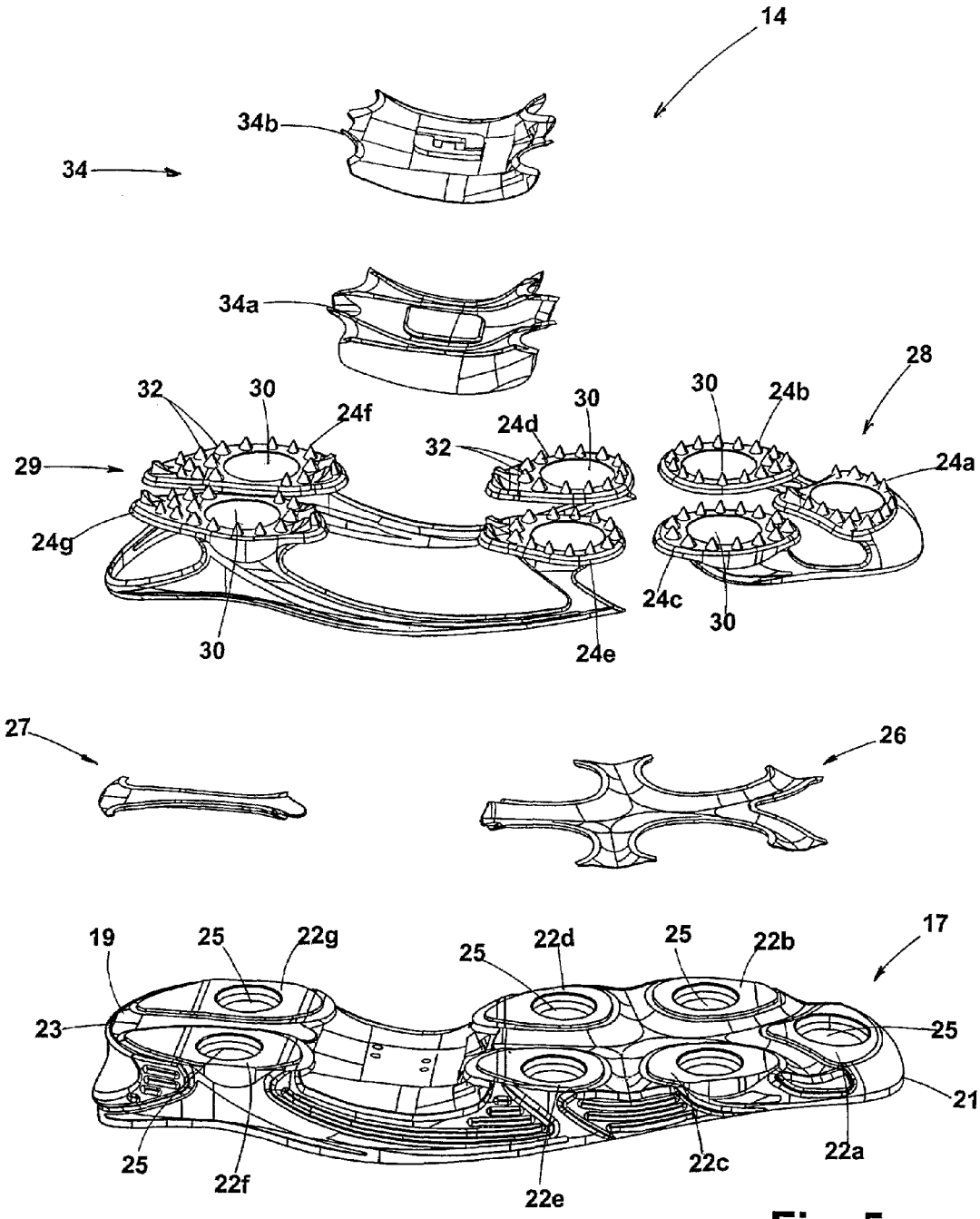
FIG. 5 is an expanded bottom view of the outsole.
Figure 6:
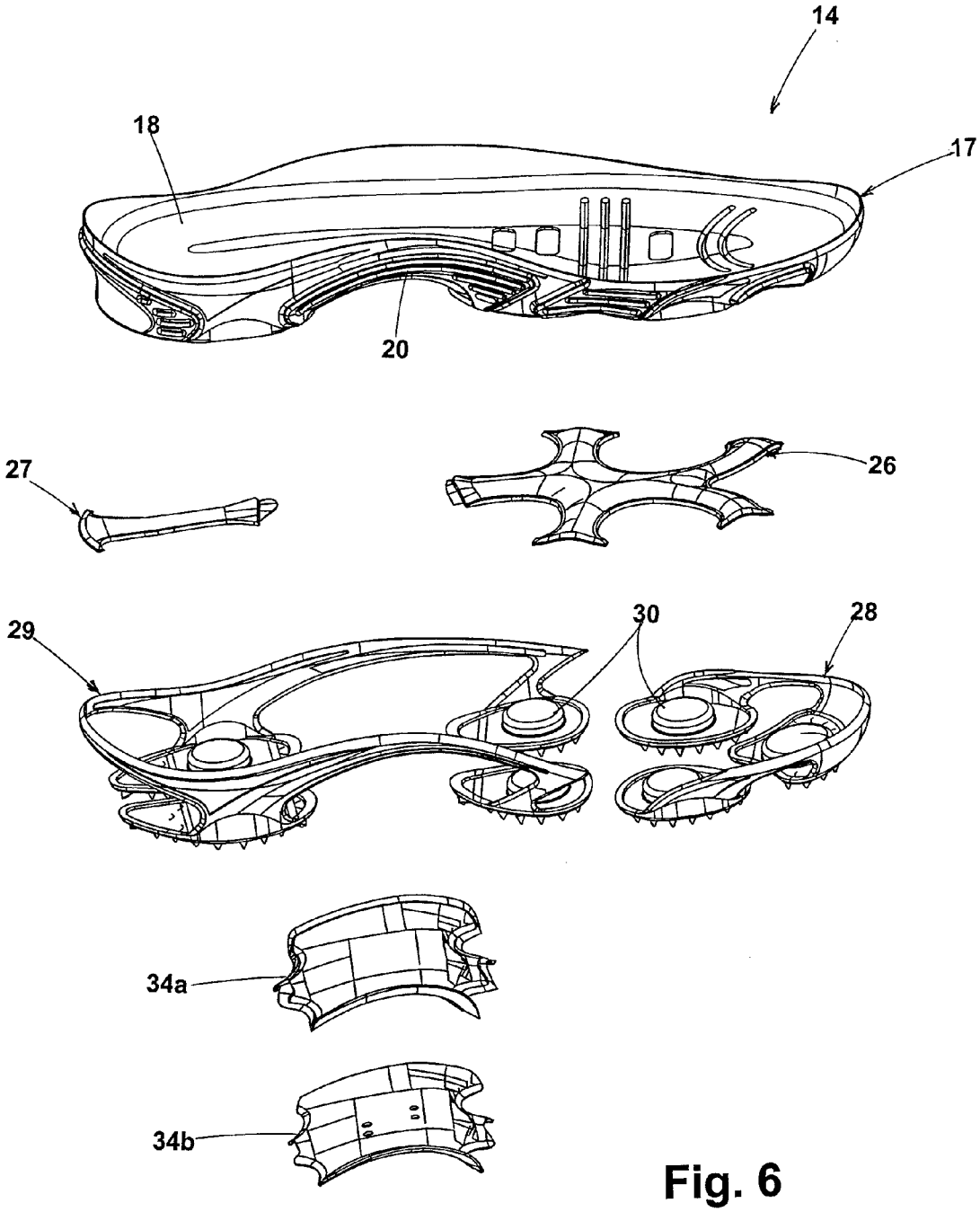
FIG. 6 is an expanded top view of the outsole.

An embodiment of the invention has an improved outsole 14 which is constructed and shown on FIGS. 2-6. As best depicted in FIGS. 5 and 6, the outsole is comprised of various parts, the construction of which begins with a relatively soft and flexible base 17. The base 17 has a plurality of raised portions 22*a*, 22*b*, 22*c*, 22*d*, and 22*e* located on its lower surface 19 on the toe region and raised portions 22*f* and 22*g* located in the on the lower surface of the rear or heel region. All raised portions are of a predetermined size and shape to adapt to the shape of the base 17. Each raised portion having defined therein a cylindrically shaped receptacle 25 for receiving a cleat attaching socket 30, discussed below.

A forward flexing support 26 is integrally disposed on the lower and forward area of the base 17 abutting the raised portions 22*a*, 22*b*, 22*c*, 22*d*, and 22*e*, while a rear support 27 is disposed abutting the raised rear portions 22*f* and 22*g*.

A molded forward chassis 28 is of a size and shape to fit over and about the forward area of the base 17, contains integral stability pods 24*a*, 24*b*, and 24*c* which are of a size and shape to be fitted about the raised portions 22*a*, 22*b* and 22*c*.

A molded rear chassis 29 is of a size and shape to be fitted about the rear area of the base 17 and further extending into and about a part of the forward area of the base in a location near to the arch 20. The rear chassis 29 contains stability pods 24*d*, 24*e*, 24*f* and 24*g* which are of a size and shape to be fitted over the corresponding raised portions 22*d*, 22*e*, 22*f* and 22*g*.

Pods 24*a* to 24*g* have sockets 30 defined therein for removably attaching cleats 11, with each socket 30 containing a spiral screw mechanism. The sockets 30 are of a size and shape to nestle into the cylindrically shaped receptacles 25 of the base 17. Extending outwardly from each pod is a plurality of relatively hard and wear resistant projections 32 which are for additional traction with for the turf.

The spiral screw type mechanism used to fasten cleats is well known in the golf ball industry and provides for releasably connecting a cleat 11 therein. The cleat 11 requires only a 45° clockwise twist turn to attach, and a 45° reverse turn to release. These type golf cleats are such as manufactured by MacNeill Engineering Worldwide under the brand name "CHAMP" and the spiral attaching mechanism of the cleat is very well known in the industry, thus not shown in detail. A cleat attaching tool is used to aid in the fastening and removal of the cleats. The tool is available at every golf supply store.

A correct golf swing requires the golf shoe to have a very rigid arch 20. The present invention provides a measure of stability by placing a two-piece shank support 34, upper 34*a* and a lower 34*b*, over the arch area 20 of the base 17. Both pieces are made of a hard plastic having a Shore A hardness of at least 95.

Most golf shoes employ turf gripping cleats 11 to provide increased traction and balance for the golfer especially when the golfer executes a golf shot. It is to be appreciated that there are "spikeless" shoes available in the market place, but the numbers show that most serious golfers still prefer some type of cleats. The number of pods and cleats are a function of the shoe style but preferably the number of pods on each shoe is between seven and nine, preferably five on the sole portion and two on the heel. Today, cleats 11 are preferably non-metallic as most golf courses make that a requirement for course play. Some of the rational for using plastic cleats is that the plastic cleats do less damage and leave less spike marks on the putting greens, but the main reason is for preservation of the course property, i.e. metal spikes can be very destructive to the flooring in a club house. Today, metal spikes are used predominantly only by golfers on the professional tours.

In a preferred embodiment, the rear and forward chassis of the outsole 14 may be formed of flexible plastic material such as thermoplastic polyurethane as manufactured by URE-TECH CO, LTD located in Taiwan under the name Utechllan UTY-75A-85A with a durometer of about a Shore A hardness of about 75 to 85. The stability pods 24*a-g* are also of a relatively hard, wear resistant polyurethane material manufactured by Ure-Tech and have a Shore A hardness of at least 95.

Figure 2:
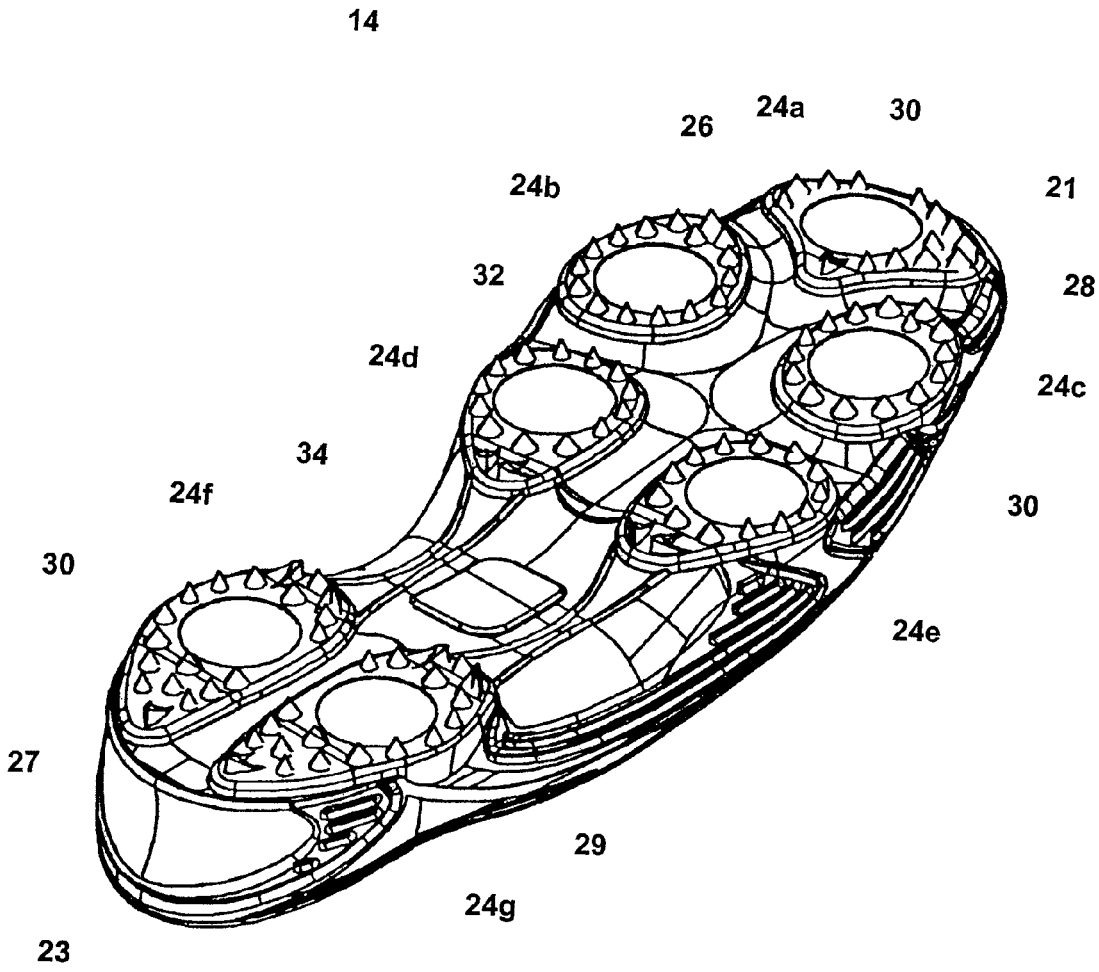
FIG. 2 is a pictorial view of the outsole of the invention.
Figure 4:
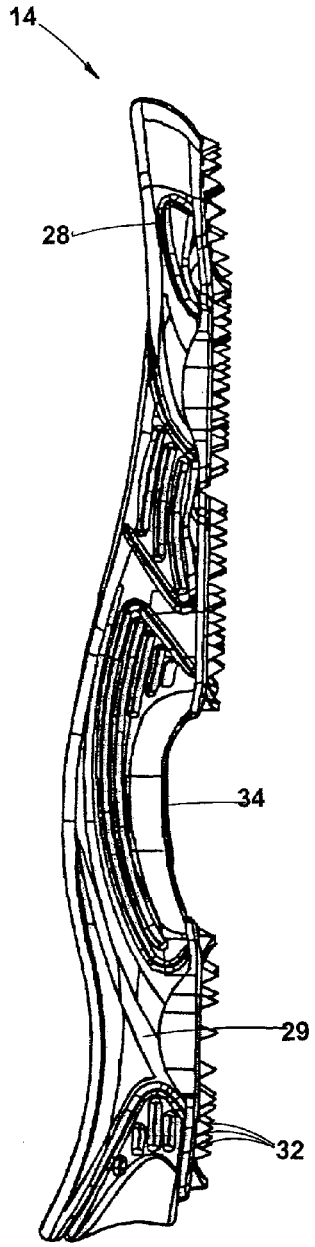
FIG. 4 is a left side view of FIG. 3.
Figure 3:
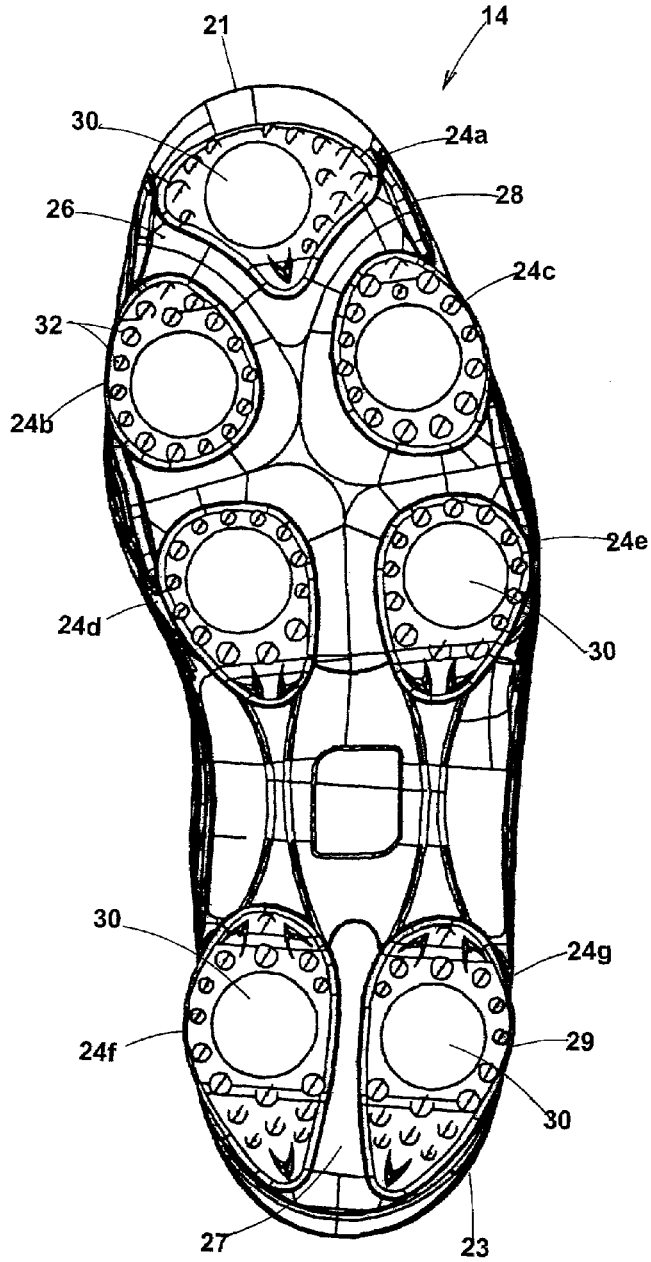
FIG. 3 is a bottom plan view of the invention.

The outer perimeters of the pods extend a minimum distance of about 6.3 mm from the bottom surface 19 of the base 17. The pods 24*a-g*, as best shown on FIGS. 2, 5 and 6, are of varying dimensions, and are spaced such that they not only allow the sole area the ability to flex across the metatarsal region, but also to allow the ability of flexing longitudinally from the toe 21 to the arch 20.

While it is apparent that the invention herein disclosed is well calculated to fulfill the objects above stated, it will be appreciated that modifications and embodiments may be devised by those skilled in the art. For example, the outsole 14 and other features thereof discussed above may be used with other types of shoes, not just golf shoes. The appended claims cover all such modifications and embodiments as fall within the true spirit and scope of the present invention.

What is claimed is:

1. A golf shoe outsole comprising:

a generally soft, and flexible base having a plurality of raised portions of a predetermined size and perimeter shape integrally molded on a lower surface of the base;

a forward flexing support disposed on the lower surface of the base abutting raised portions near a toe region and a rear flexing support disposed on the lower surface of the base abutting raised portions near a heel region;

a forward chassis having a plurality of integrally molded stability pods, the forward chassis of a size and shape for fitting over and about the forward area of the base and each stability pod of a size and shape for fitting over a corresponding raised portion;

a rear chassis having a plurality of integrally molded stability pods, the rear chassis of a size and shape for fitting over and about the rear area of the base and extending forward to fit over a rear area of the base, each stability pod of a size and shape for fitting over a corresponding raised portion; and a two-piece arch support integrally connected to an arch area to provide necessary rigidity to the base, wherein the shoe has a greater degree of flexibility and traction with turf, and therefore greater stability and balance to the user.

2. The outsole of claim 1, wherein there are three pods on the forward chassis.

3. The outsole of claim 1, wherein there are four pods on the rear chassis.

4. The outsole of claim 1, wherein each pod has a plurality of relatively hard wear resistant projections extending downwardly outward thereof.

5. The outsole of claim 4, wherein the Shore A hardness of the projections is at least 95.

6. The outsole of claim 1, wherein the plurality of pods have a minimum Shore A hardness of 95.

7. The outsole of claim 1, wherein the pods extend at least 6.3 mm from a bottom surface of the base.

8. The outsole of claim 1, wherein the base is made from relatively thin flexible thermoplastic polyurethane having a Shore A hardness between 75 to 85.

9. The outsole of claim 8, wherein the base is made from relatively thin flexible thermoplastic polyurethane having a Shore A hardness no greater than 75.

10. The outsole of claim 1, wherein each raised section has defined therein a relatively round receptacle for releasably connecting a cleat attaching means.

11. The outsole of claim 10, wherein the cleat attaching means comprises a socket defined in each pod, the socket containing a spiral screw type mechanism, wherein a cleat may be releasably attached by a 45° clockwise twist turn, and released with a 45° counterclockwise turn.

12. A golf shoe comprising:

an upper;

an outsole;

a midsole connecting the upper and top surface of the outsole;

the outsole comprising a base, forward and rear flexing supports, forward and rear chassis, a two-piece arch support and golf cleats;

a plurality of raised portions integrally molded on the lower surface of the base, each raised portion having a generally cylindrical receptacle defined therein;

said forward and rear chassis of a size and shape for fitting about the base;

said forward and rear chassis having a plurality of integrally molded stability pods, the pods of a size and dimension to fit about the raised portions;

each stability pod having a spiral socket for removably attaching one of the cleats, the socket of a size and shape for fitting into one of the cylindrical receptacles; and said two-piece arch support shank integrally connected to an arch area to provide necessary rigidity to the base.

13. The outsole of claim 12, wherein there are three pods on the forward chassis.

14. The outsole of claim 12, wherein there are four pods on the rear chassis.

15. The outsole of claim 12, wherein each pod has a plurality of relatively hard wear resistant projections extending downwardly outward thereof.

16. The outsole of claim 15, wherein the Shore A hardness of the projections is greater than 95.

17. The outsole of claim 15, wherein the plurality of pods have a minimum Shore A hardness of 95.

18. The outsole of claim 17, wherein the pods extend at least 6.3 mm from a bottom surface of the base sections.

19. The outsole of claim 12, wherein the base is made from relatively thin flexible thermoplastic polyurethane having a Shore A hardness between 75 to 85.

20. The outsole of claim 19, wherein the base is made from relatively thin flexible thermoplastic polyurethane having a Shore A hardness no greater than 75.

21. The outsole of claim 12, wherein the socket for attaching the cleat comprises a spiral screw type mechanism, wherein a cleat may be releasably attached by a 45° clockwise twist turn, and released with a 45° counterclockwise turn.

* * * * *